US008091480B2

(12) United States Patent
Lübbers

(10) Patent No.: US 8,091,480 B2
(45) Date of Patent: Jan. 10, 2012

(54) IRRITATION BODY WITH ADDITIONAL EFFECT

(75) Inventor: Thorsten Lübbers, Lütjensee (DE)

(73) Assignee: Rheinmetall Waffe Munition GmbH, Unterlüß (DE)

( * ) Notice: Subject to any disclaimer, the term of this patent is extended or adjusted under 35 U.S.C. 154(b) by 0 days.

(21) Appl. No.: 12/624,343

(22) Filed: Nov. 23, 2009

(65) Prior Publication Data

US 2010/0199874 A1 Aug. 12, 2010

Related U.S. Application Data

(60) Provisional application No. 61/239,622, filed on Sep. 3, 2009.

(30) Foreign Application Priority Data

Nov. 24, 2008 (DE) ..... 10 2008 058 776

(51) Int. Cl.
*F42B 12/46* (2006.01)

(52) U.S. Cl. ..... 102/368

(58) Field of Classification Search ..... 102/368, 102/367, 498, 482, 370, 334, 360, 352, 364, 102/355, 502, 487, 488, 489
See application file for complete search history.

(56) References Cited

U.S. PATENT DOCUMENTS

| | | | | |
|---|---|---|---|---|
| 2,094,562 | A * | 9/1937 | Lowy | 102/368 |
| 3,110,256 | A * | 11/1963 | Barber | 102/367 |
| 3,238,143 | A * | 3/1966 | Ainsley et al. | 102/334 |
| 3,311,054 | A * | 3/1967 | Foster et al. | 102/334 |
| 3,795,197 | A | 3/1974 | Levenson | |
| 3,980,139 | A | 9/1976 | Kirk | |
| 4,444,111 | A * | 4/1984 | Luebbers | 102/360 |
| 4,947,753 | A * | 8/1990 | Nixon, III | 102/487 |
| 4,976,201 | A * | 12/1990 | Hamilton | 102/323 |
| 5,085,147 | A | 2/1992 | Gold et al. | |
| 5,654,523 | A | 8/1997 | Brunn | |
| 5,983,801 | A * | 11/1999 | Brunn | 102/334 |
| 6,546,874 | B2 * | 4/2003 | Vasel et al. | 102/444 |
| 7,121,353 | B2 * | 10/2006 | Setzer | 169/28 |
| 7,194,960 | B2 * | 3/2007 | Vasel et al. | 102/502 |

(Continued)

FOREIGN PATENT DOCUMENTS

DE 28 42 797 A1 4/1980

(Continued)

OTHER PUBLICATIONS

Machine English translation of FR 1 473 621 obtained from the European Patent Office website on Jun. 26, 2011, 2 pages, submitted herewith as Exhibit A.

(Continued)

*Primary Examiner* — Bret Hayes
*Assistant Examiner* — Reginald Tillman, Jr.
(74) *Attorney, Agent, or Firm* — Griffin & Szipl, P.C.

(57) ABSTRACT

An irritation body (1) is proposed that has a container (5) and a first effect charge as well as an ignition mechanism (3) and an ignition cap (4), which now has in the free area on the floor (8) of the irritation body (1) an additional body (10) provided with a further or second effect charge (11). The housing (12) of the additional body (10) is preferably made of plastic and contains, for example, metal dust as the second effect charge (11).

8 Claims, 2 Drawing Sheets

U.S. PATENT DOCUMENTS

| | | | | |
|---|---|---|---|---|
| 7,721,651 | B2 * | 5/2010 | Lubbers et al. | 102/498 |
| 7,832,493 | B2 * | 11/2010 | Gross et al. | 169/84 |
| 2008/0276822 | A1 | 11/2008 | Lubbers et al. | |

FOREIGN PATENT DOCUMENTS

| | | | |
|---|---|---|---|
| DE | 9210649 | U1 | 12/1992 |
| DE | 9213376 | U1 | 1/1993 |
| DE | 9213375 | U1 | 2/1993 |
| DE | 19944486 | C2 | 6/2003 |
| DE | 10259913 | A1 | 7/2004 |
| DE | 102004059991 | B4 | 3/2007 |
| FR | 1 473 621 | | 3/1967 |
| RU | 76 439 | U1 | 9/2008 |
| WO | 94/08200 | | 4/1994 |
| WO | 01/20243 | A1 | 3/2001 |
| WO | 2006/137888 | A2 | 12/2006 |

OTHER PUBLICATIONS

International Preliminary Report on Patentability issued in corresponding International Application No. PCT/EP2009/008132, completed Mar. 2, 2010.

* cited by examiner

IRRITATION BODY WITH ADDITIONAL EFFECT

This application claims priority of U.S. Provisional Patent Application No. 61/239,622, filed Sep. 3, 2009, and claims priority of German Patent Application No. DE 10 2008 058 776.1, filed Nov. 24, 2008. The entire disclosures of which are incorporated herein by reference.

FIELD OF THE INVENTION

The invention relates to an irritation body, also called shock weapon, according to the preamble, but with additional effects.

BACKGROUND OF THE INVENTION

Irritation bodies are used, e.g., in hostage-taking or aircraft hijacking, to support police or military actions. They are similar to a hand grenade, which are ignited manually as a rule and then flung away.

An irritation body with impulse gears is known from DE 102 59 913 B4. The irritation body is shifted into rolling movements by means of the impulse gears.

Various shock weapons are known to the applicant from DE 92 10 649 U1, DE 92 13 375 U1, as well as DE 92 13 376 U1.

Various further irritation bodies of the applicant can be taken from DE 199 44 486 C2 or DE 10 2004 059 991 B4. DE 199 44 486 C2 is concerned thereby with the physical structure of the compartments integrated in the container, while DE 10 2004 059 991 B4 relates to the cross-sections of blow-out openings of the compartments.

Now the demand is made on such irritation bodies in particular to increase the duration of the vision impairment, i.e. they must fulfill other performance requirements. A first thought would be to change the construction, which, for example, would lead to a larger form.

The object of the invention is to set forth an irritation body that meets the above-mentioned demand for fulfillment of a higher performance.

SUMMARY OF THE INVENTION

The object is achieved by the features of a first embodiment of the invention, which pertains to an irritation body (1) provided with a container (5) and an effect charge as well as an ignition mechanism (3) and an ignition cap (4), characterized in that an additional body (10) with a further effect charge (11) is integrated in the free area (8) on the floor of the irritation body (1). Advantageous additional embodiments are outlined as follows.

In accordance with a second embodiment of the invention, an irritation body according to the first embodiment is modified so that the housing (12) of the additional body (10) is made of plastic. In accordance with a third embodiment of the invention, the first embodiment or the second embodiment is further modified so that the second effect charge (11) is metal dust. In accordance with a fourth embodiment of the invention, the first embodiment, the second embodiment and the third embodiment are further modified so that the additional body (10) can also be subsequently inserted, clamped in, or screwed in, to the housing (12).

The invention is based on the concept, utilizing the available construction space, of placing an additional body in the free space on the floor of an irritation body and integrating an additional effect charge into this. In a particular embodiment, providing an increase in the vision impairment effect, an actually inert metal dust is used and this dust is embedded in the additional body as a further effect charge. Through the blast wave and the exiting combustion gases of the flash composition (i.e., first effect charge), the additional body is destroyed and the metal dust, for example aluminum or magnesium, is distributed and ignited.

The additional body comprises a readily ignitable material, preferably plastic, in order to avoid the formation of splinters, in particular outside the safety range (10 m).

The advantage is that the sound output can be maintained, since it is not minimized. The additional body can be adapted individually and thereby optionally directly before use. A new qualification or hazardous material classification is not necessary.

The invention is to be described in more detail based on an exemplary embodiment with drawing.

BRIEF DESCRIPTION OF THE DRAWINGS

They show.

DETAILED DESCRIPTION OF THE DRAWINGS

Figure 1:
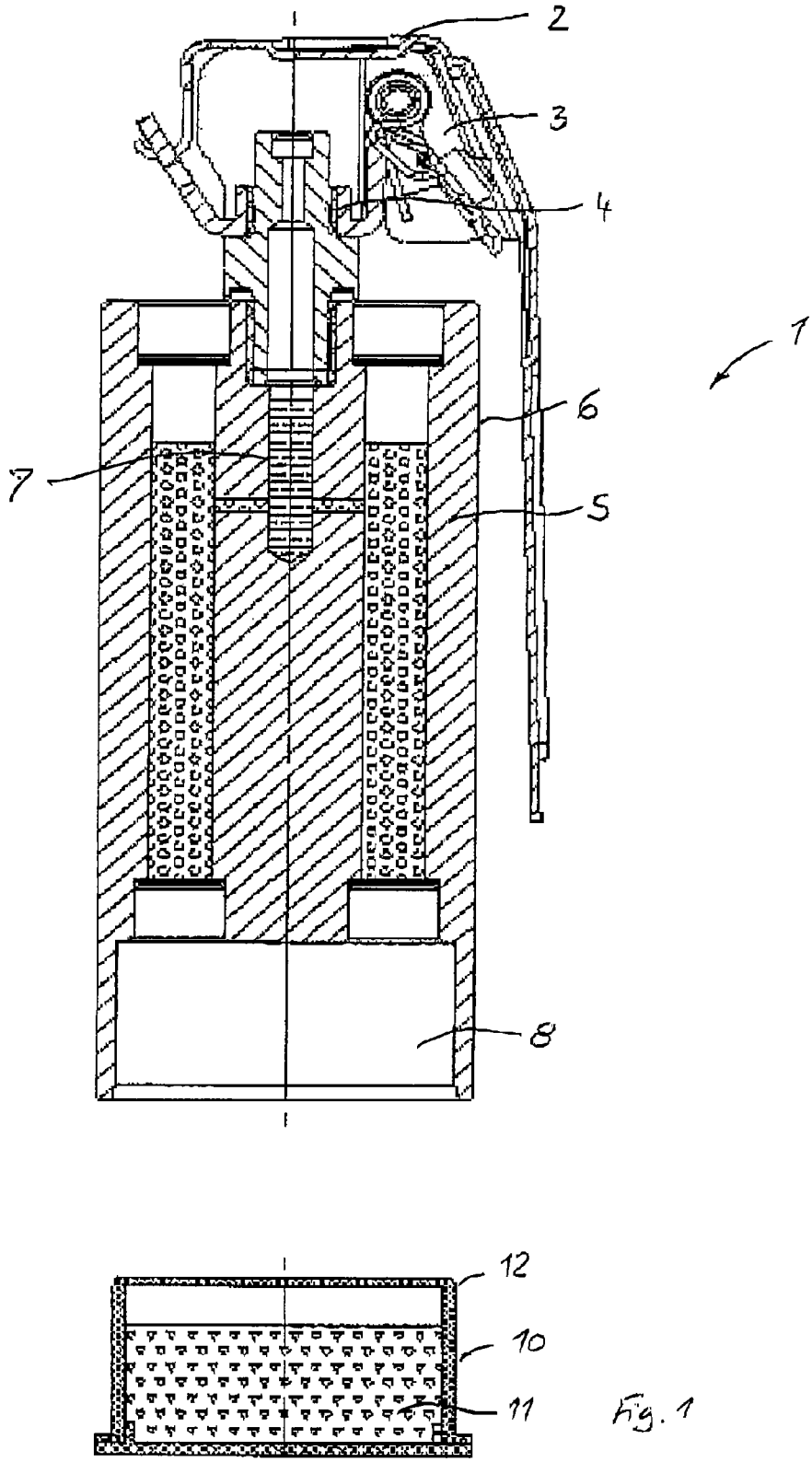
FIG. 1 An irritation body as well as an additional body, separately.
Figure 2:
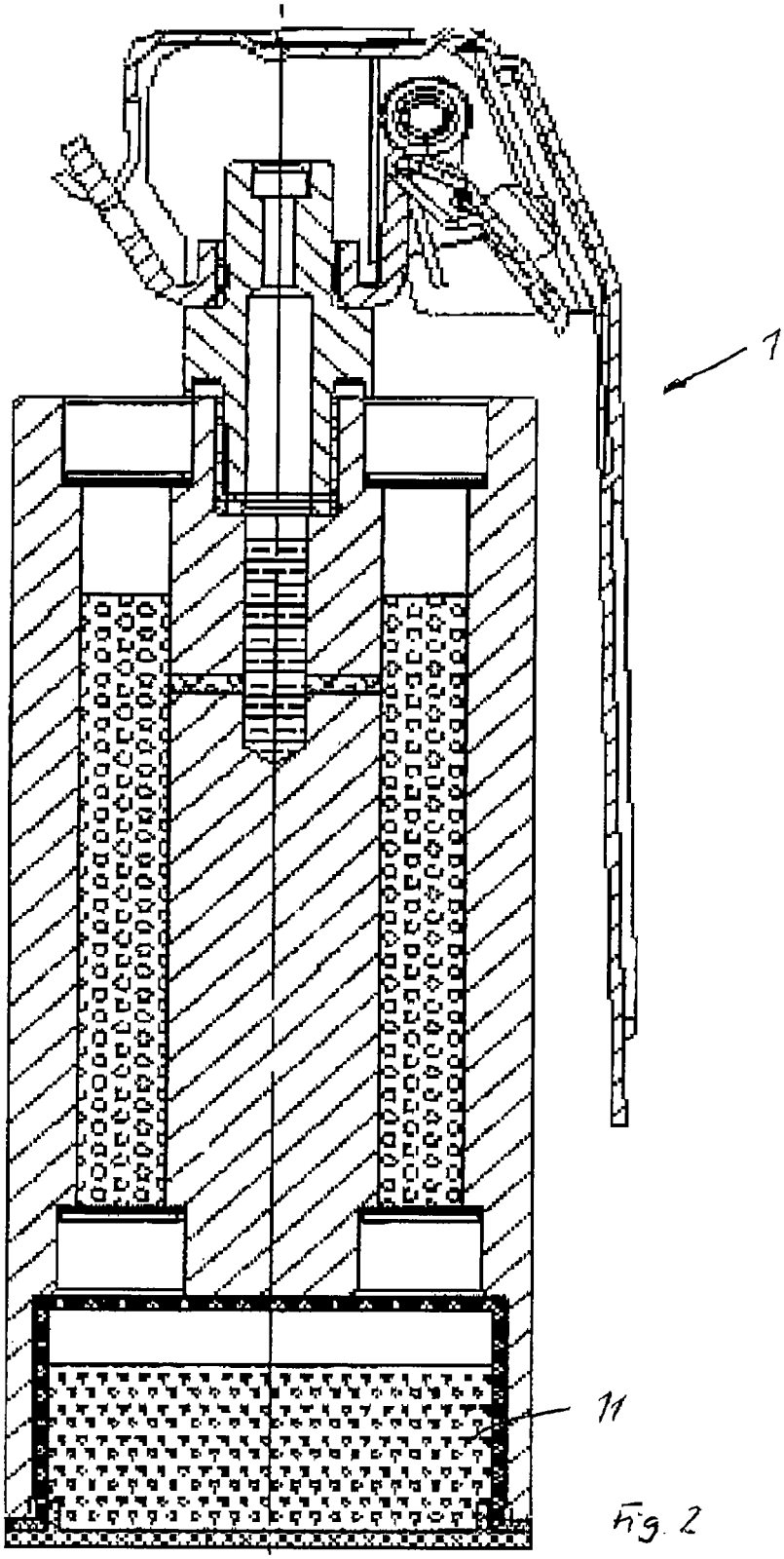
FIG. 2 An additional body inserted into the irritation body.

Both FIG. 1 and FIG. 2 show an irritation body 1, shown here with a tipping lever igniter 2, which includes an ignition mechanism 3 with at least one firing pin that during the functioning of the irritation body 1 encounters an ignition cap 4, in order to ignite a central delay composition 7 via an ignition charge. Furthermore the irritation body 1 includes a container 5 that can be closed on the outside by a cover 6 or the like. Further details about this are disclosed in DE 10 2004 059 991 B4, to which reference is made herewith. U.S. Patent Application No. US 2008/0276822 A1, which is the equivalent of DE 10 2004 059 991 B4, is incorporated herein by reference in its entirety.

A first effect charge is housed in the container 5.

An additional body 10 is integrated in the lower free area 8 on the floor of the irritation body 1, which additional body is equipped with additional effects in the form of a further (second) effect charge, in accordance with the desired additional effects. In the present exemplary embodiment, the additional body 10 contains a metal dust 11 with the task of likewise burning and thus increasing the vision impairment, from, for example, 2 seconds to 10 seconds. The body 10 or the housing 12 is preferably made of a readily destructible material, for example, of plastic. The body 12 can subsequently be inserted, clamped in, or screwed in on-site.

The functioning of the irritation body 1 as such is conventional and known. The tipping lever igniter 2 is disengaged and released when the body 1 is, for example, flung away. The ignition mechanism 3 with its firing pin encounters the ignition cap 4 and ignites the entire system. When the system is activated, the additional body 10 is torn apart by the pressure gases, and the metal dust 11 is released and ignited.

The invention claimed is:

1. An irritation body comprising:

(a) a container;

(b) a first effect charge housed in the container;

(c) an ignition cap;

(d) an ignition mechanism disposed to encounter the ignition cap in order to ignite the first effect charge;

(e) an additional body provided with a second effect charge that is integrated in a free area on a floor of the irritation body, wherein the additional body comprises a housing made of a readily destructible material, and wherein when the ignition mechanism encounters the ignition cap thereby igniting the first effect charge, the additional body is destroyed by a blast wave and exiting combustion gases and the second effect charge is distributed and ignited.

2. An irritation body according to claim 1, wherein the readily destructible material of the housing is plastic.

3. An irritation body according to claim 1, wherein the second effect charge comprises ignitable metal dust.

4. An irritation body according to claim 1, wherein the additional body is subsequently insertable, clampable, or screwable, into the free area on the floor of the irritation body.

5. An irritation body according to claim 2, wherein the second effect charge comprises ignitable metal dust.

6. An irritation body according to claim 2, wherein the additional body is subsequently insertable, clampable, or screwable, into the free area on the floor of the irritation body.

7. An irritation body according to claim 3, wherein the additional body is subsequently insertable, clampable, or screwable, into the free area on the floor of the irritation body.

8. An irritation body according to claim 5, wherein the additional body is subsequently insertable, clampable, or screwable, into the free area on the floor of the irritation body.

* * * * *